US007513588B2

(12) United States Patent
Huang

(10) Patent No.: US 7,513,588 B2
(45) Date of Patent: Apr. 7, 2009

(54) APPARATUS AND METHOD FOR SUPPLYING VOLTAGE TO NOZZLE IN INKJET PRINTER

(75) Inventor: Yao-Te Huang, Taoyuan (TW)

(73) Assignee: Qisda Corporation, Taoyuan County (TW)

( * ) Notice: Subject to any disclaimer, the term of this patent is extended or adjusted under 35 U.S.C. 154(b) by 299 days.

(21) Appl. No.: 11/382,951

(22) Filed: May 12, 2006

(65) Prior Publication Data

US 2006/0256149 A1 Nov. 16, 2006

(30) Foreign Application Priority Data

May 13, 2005 (TW) ..... 94115703 A

(51) Int. Cl.
*B41J 2/01* (2006.01)

(52) U.S. Cl. ..... 347/14

(58) Field of Classification Search ..... 347/190, 347/192, 14, 19
See application file for complete search history.

(56) References Cited

U.S. PATENT DOCUMENTS 5,469,203 A * 11/1995 Hauschild ..... 347/190
5,677,577 A * 10/1997 Barbehenn et al. ..... 307/98
6,334,660 B1 1/2002 Holstun et al.
6,386,674 B1 5/2002 Corrigan, III et al.

FOREIGN PATENT DOCUMENTS

| | | | |
|---|---|---|---|
| CN | 1091036 | C | 10/1997 |
| DE | 4020885 | A1 | 1/1992 |
| EP | 0931663 | A2 | 7/1999 |

* cited by examiner

*Primary Examiner*—Huan H Tran

(57) ABSTRACT

A power supplying apparatus for a plurality of nozzles included in a thermal inkjet printer is provided. The thermal inkjet printer is capable of providing a plurality of printing modes. The power supplying apparatus includes a look-up table, a selecting module, and an adjustable voltage supply. The look-up table stores plural sets of control signals corresponding to the plurality of printing modes. The selecting module first receives a command representing that a user selects one printing mode among the plurality of printing modes as a final printing mode. The selecting module then selects one set of control signals stored in the look-up table as a set of final control signals based on the command. The adjustable voltage supply supplies at least one voltage to the plurality of nozzles based on the final control signal selected by the selecting module.

9 Claims, 6 Drawing Sheets

APPARATUS AND METHOD FOR SUPPLYING VOLTAGE TO NOZZLE IN INKJET PRINTER

BACKGROUND OF THE INVENTION

1. Field of the Invention

This invention is related to a power supplying apparatus. More specifically, this invention relates to a power supplying apparatus for a print head comprised in a thermal inkjet printer.

2. Description of the Prior Art

At the present day, thermal inkjet printers are prevalent printers. Monochrome inkjet printers generally include a print head for providing black ink; color inkjet printers generally further include several print heads for providing inks of basic colors. Each black or color print head has a plurality of nozzles, respectively. Nozzles are the components that actually eject inks. Most inkjet printers are capable of providing a plurality of printing modes; each printing mode corresponds to a respective print resolution and a respective print quality. According to different settings of print resolution, the number of nozzles being used changes. That is to say, a printer controls different nozzles to act based on the printing mode selected by a user. A complete character or figure is formed with lots of tiny ink drops ejected by nozzle. Since each character and each figure are different from other, the number of nozzles being used is uncertain.

The working principle of thermal inkjet printers is briefly explained as follows. When a certain nozzle is assigned to act, a voltage impulse is provided to a heater in the nozzle so that the heater can generate heats rapidly. A small bubble is created and gradually grows up in the nozzle due to the heats. An ink drop near the output of the nozzle is then pushed out by the bubble so that the ink drop is ejected to a paper and forms a small ink point. After the voltage impulse is ended, the heater cools down, the bubble disappears, and the other ink in the nozzle shrinks back to the inner side of the nozzle. Please refer to FIG. 1. FIG. 1 shows the typical connecting relation between a power source 10 and the nozzles (111, 112, and 113) in a print head 11. The power source 10 is used for providing voltage impulses to the nozzles. Each nozzle respectively includes a heater (111A, 112A, and 113A) and a switch (111A, 112A, and 113A).

The nozzle 111 is taken as an example. When the switch 111 B is opened, the heater 111A is not conducted to the ground. Therefore, there is no current flowing through the heater 111A and no voltage drop is formed between the two ends of the heater 111A. If the nozzle 111 is assigned to act in certain operation, the switch 111B is closed so that the heater 111A is conducted to the ground through the switch 111B. Subsequently, the power supply 10 provides current to the nozzle 111 and there is a voltage drop formed between the two ends of the heater 111A. An ink drop near the output of the nozzle 111 is then pushed out by the bubble generated by the heater 111A to form an ink point.

FIG. 2 further shows the schematics of the nozzles in actual applications. As shown in FIG. 2, each switch of the nozzles can be composed of a sub-switch (111C, 112C, 113C) and a MOS device (111D, 112D, 113D). When the sub-switch 111C is closed, the gate of the MOS device 111D is connected to the power supply 10 and the MOS device 111D is then conducted. In this way, the heater 111A can be conducted to the ground through the MOS device 111D.

Each heater, each switch, and even the connecting wires between the power supply 10 and the print head 11 are all loadings for the power supply 10. As known to people skilled in the art, the output impedance of an ideal voltage supply is zero, thus, regardless of the value of loadings, an ideal voltage supply can provide a constant output voltage. However, in actual situations, the output voltage provide by the power supply 10 varies with different loadings.

As shown in FIG. 1, if the nozzle 111 and nozzle 112 are assigned to act simultaneously, the heater 111A and the heater 112A are parallel. The equivalent loading formed by the two parallel heaters is half of the loading formed by a single heater (assuming the resistances of the heater 111A and the heater 112A are the same). Since the number of nozzles being used is uncertain under various conditions, the loading formed by the nozzles also changes for the power supply 10. Therefore, the voltage drop generated between the two ends of a heater is inevitably affected by the amount of loadings.

Presently, most inkjet printers use constant voltages to drive print heads. Once the voltage is affected by different loadings and connecting wires, the voltage supplied to the heaters might be insufficient or too much so that the ink drops in nozzles cannot be ejected or too big. Thus it shows loading problem does decrease printing quality of inkjet printers.

Please refer to FIG. 3. FIG. 3 shows the other prior art including two power supplies. The first power supply 20A is used for providing voltages to the heaters; the second power supply 20B is used for selectively providing voltages to the gates of the MOS devices. The main difference between FIG. 3 and FIG. 2 is that the voltage values for heaters and switches are different; thus, two power supplies are required. The prior art shown in FIG. 3 also has the aforementioned problem of voltage variations.

SUMMARY OF THE INVENTION

To solve the aforementioned problems, this invention proposes an apparatus and a method for providing voltages to nozzles included in a thermal inkjet printer. The apparatus and method according to this invention bring the impedances of nozzles into consideration. According to the number of nozzles to be used in different printing modes, this invention previously compensates the voltage variations caused by the impedances of nozzles and connecting wires. Thus, stable and accurate voltages can be provided. One preferred embodiment according to this invention is a power supplying apparatus. The power supplying apparatus includes a look-up table, a selecting module, and an adjustable voltage supply. Plural sets of control signals corresponding to a plurality of printing modes are stored in the look-up table. After receiving a command representing that a user selects one printing mode among the plurality of printing modes as a final printing mode, the selecting module selects one set of control signals among the plural sets of control signals stored in the look-up table as a set of final control signals according to the command. The set of final control signals is corresponding to the final printing mode. The adjustable voltage supply is used for supplying at least one voltage to the plurality of nozzles based on the set of final control signals selected by the selecting module.

The other preferred embodiment according to this invention is a method of controlling an adjustable voltage supply for a print head comprised in a thermal inkjet printer. In this embodiment, a look-up table is previously provided for storing plural sets of control signals corresponding to a plurality of printing modes. The first step in the method is receiving a command representing that a user selects one printing mode among the plurality of printing modes as a final printing mode. The second step is selecting one set of control signals among the plural sets of control signals stored in the look-up table as a set of final control signals according to the command received in the first step. The set of final control signals is corresponding to the final printing mode. The third step of this method is adjusting the adjustable voltage supply such that the adjustable voltage supply provides at least one voltage corresponding to the set of final control signals to the plurality of nozzles.

The advantage and spirit of the invention may be understood by the following recitations together with the appended drawings.

BRIEF DESCRIPTION OF THE APPENDED DRAWINGS

FIG. 1 shows the typical connecting relation between a power source and the nozzles in a print head.

FIG. 2 further shows the schematics of the nozzles in FIG.1.

DETAILED DESCRIPTION OF THE INVENTION

The main purpose of this invention is proposing an apparatus and a method for providing voltages to a print head included in a thermal inkjet printer. The print head includes a plurality of nozzles. The thermal inkjet printer is capable of providing a plurality of printing modes; each printing mode is corresponding to a respective number of nozzles included in the print head.

Figure 1:
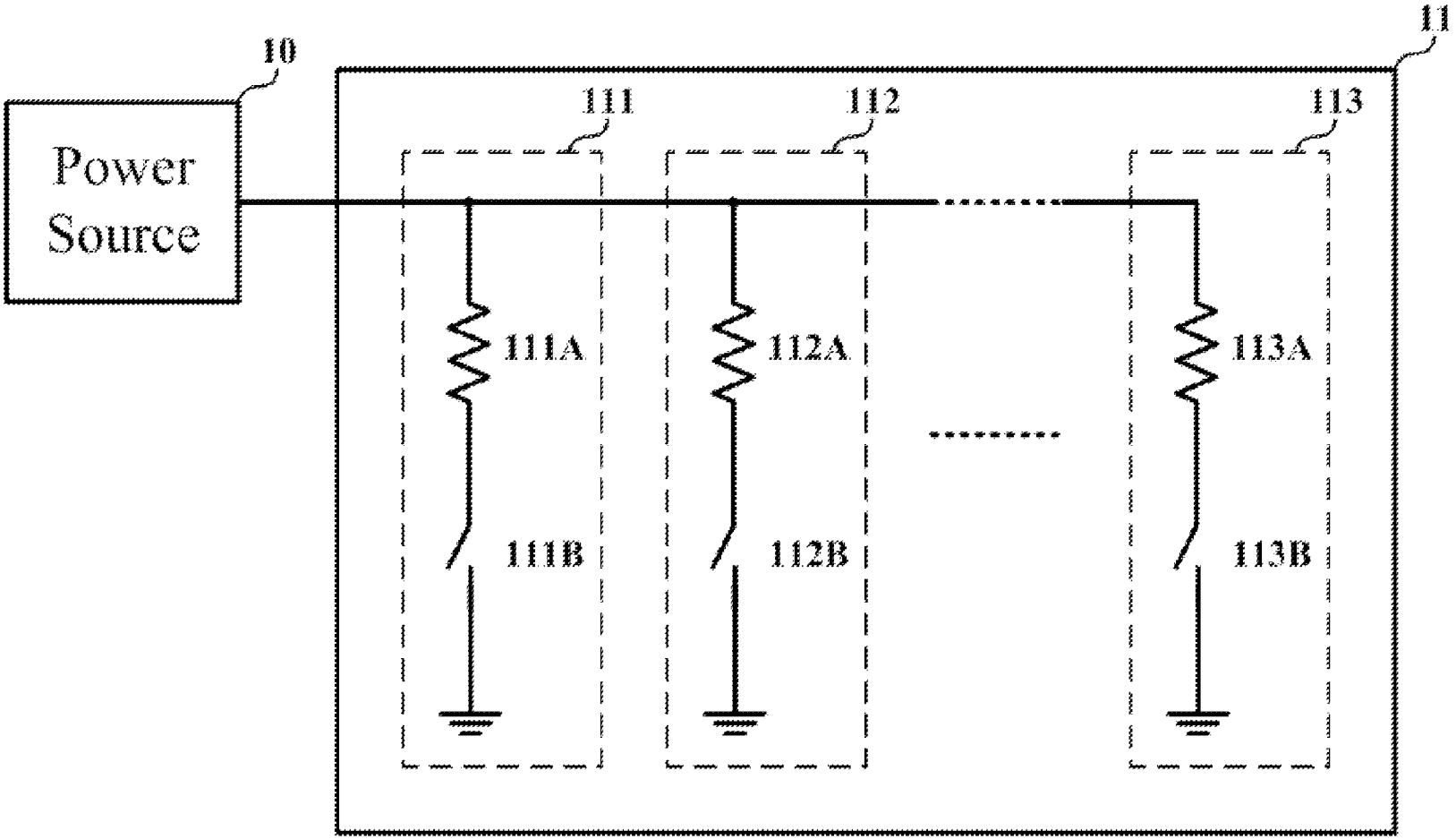
FIG.1 (Prior Art)
Figure 2:
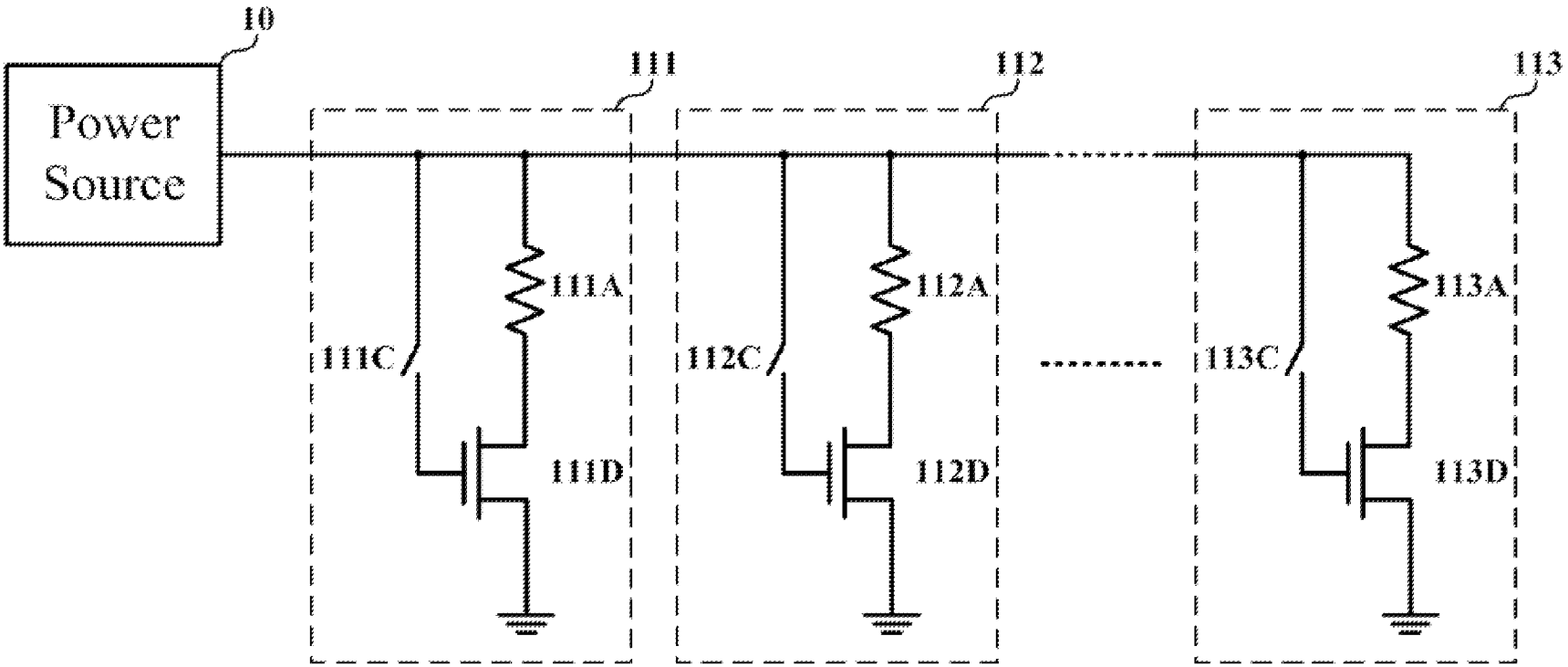
FIG.2 (Prior Art)
Figure 3:
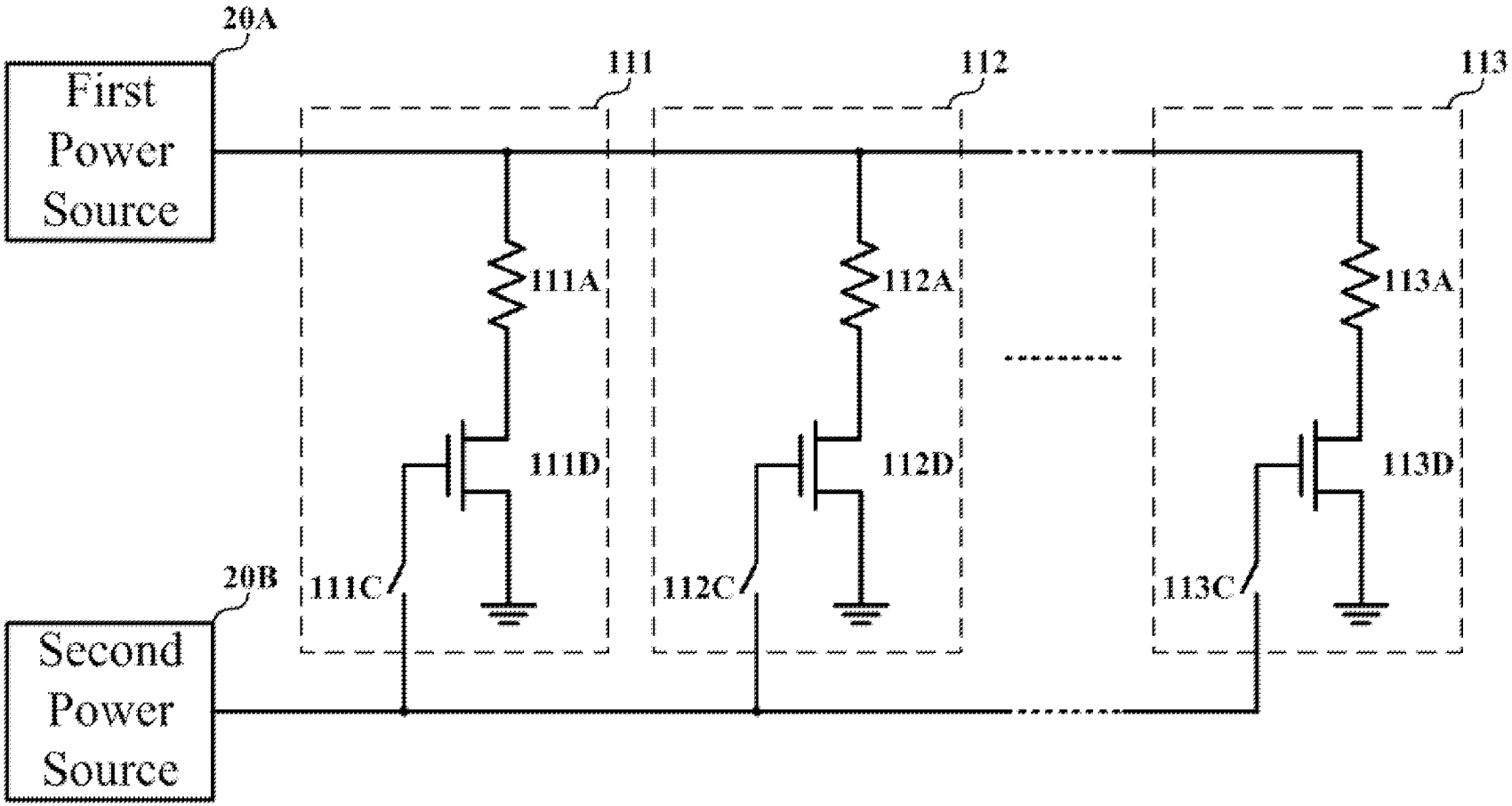
FIG.3 (Prior Art)
FIG. 3 shows the other prior art including two power supplies.
Figure 4:
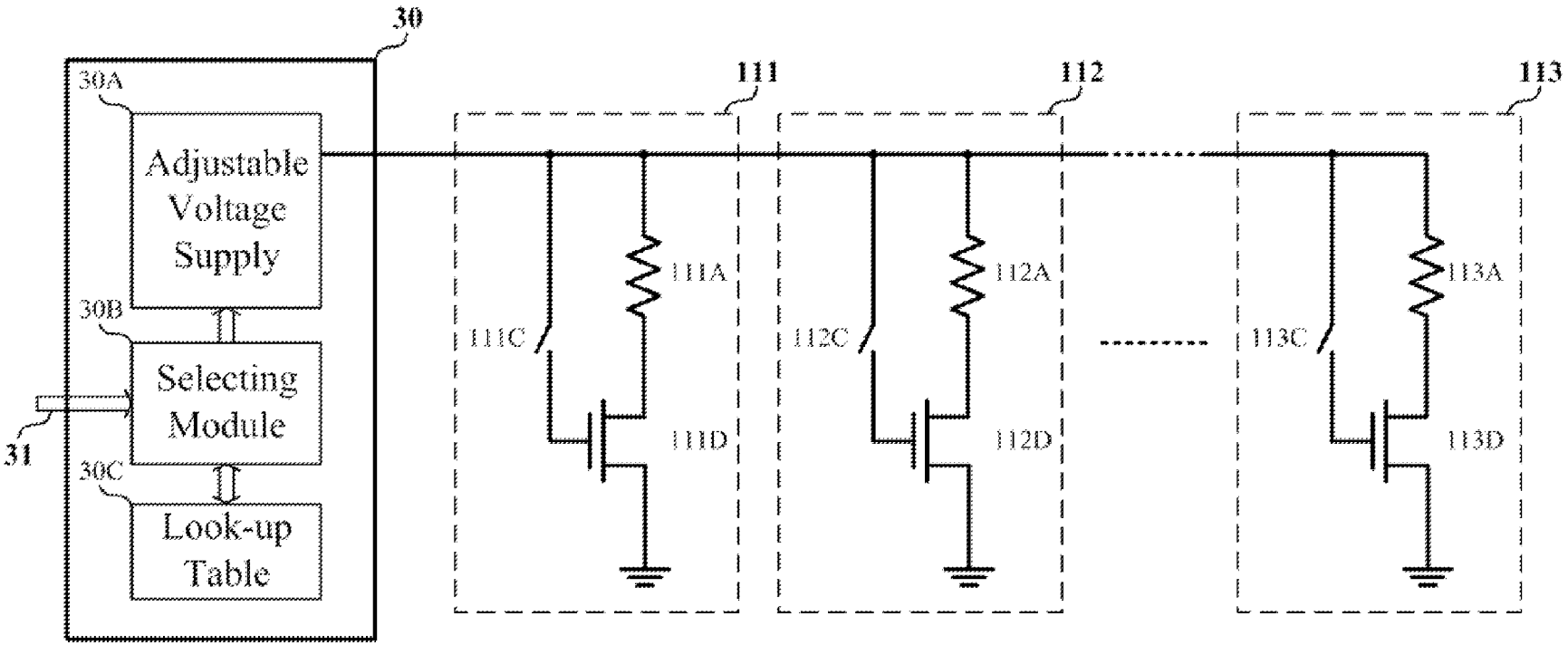
FIG. 4 shows the block diagram of the power supplying apparatus of the first preferred embodiment according to this invention.

The first preferred embodiment according to this invention is a power supplying apparatus. Please refer to FIG. 4. FIG. 4 shows the block diagram of this power supplying apparatus. The power supplying apparatus 30 includes an adjustable voltage supply 30A, a selecting module 30B, and a look-up table 30C. Each nozzle shown in FIG. 4 includes a heater, a MOS device, and a switch.

In this invention, the loadings caused by the impedances of nozzles and connecting wires under different conditions are previously calculated. Then, the adjustment amounts corresponding to different loadings are also evaluated for the power supplying apparatus 30. Thus, the power supplying apparatus 30 can be adjusted in advance to supply accurate voltages. The look-up table 30C is used for storing plural sets of control signals for the power supplying apparatus 30 corresponding to different loadings.

In actual applications, the adjustable voltage supply 30A is connected to the plurality of nozzles via a bus line. A bus line generally has serial impedances that also diminish voltages. Furthermore, due to the effects of parasitic resistances and parasitic capacitances, the time when the nozzles receive voltages (or currents) is later than the time when the power supplying apparatus 30 starts to send out voltages (or currents). To timely provide enough power required at the instant that nozzles are opened, information about the delay time can also be stored in the look-up table 30C according to this invention so that the voltage supplied by the power supplying apparatus 30 can be adjusted in advance. That is to say, the plural sets of control signals can also be relative to the serial impedances of bus lines.

After receiving a command 31 representing that a user selects one printing mode among the plurality of printing modes as a final printing mode, the selecting module 30B selects one set of control signals among the plural sets of control signals stored in the look-up table 30C as a set of final control signals according to the command 31. In actual applications, the look-up table 30C and the selecting module 30B can be integrated as a control unit. The adjustable voltage supply 30A is used for supplying at least one voltage to the plurality of nozzles (111, 112, and 113) based on the set of final control signals selected by the selecting module.

Figure 5:
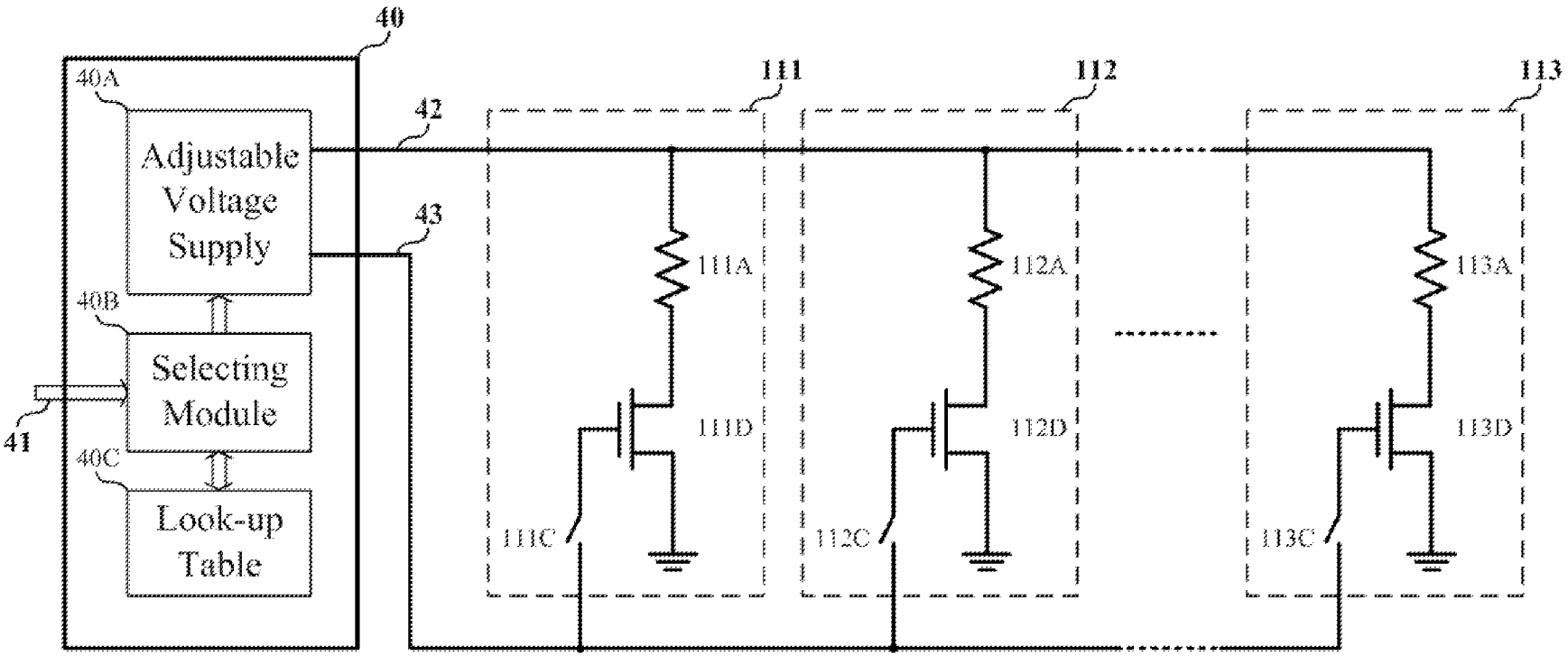
FIG. 5 shows the block diagram of the power supplying apparatus of the second preferred embodiment according to this invention.

Please refer to FIG. 5. FIG. 5 shows the block diagram of the power supplying apparatus of the second preferred embodiment according to this invention. The working principle of the power supplying apparatus 40 is the same as the power supplying apparatus 30 in FIG. 4. In this embodiment, the voltage values for heaters and switches are different. Accordingly, the power supplying apparatus 40 provides two voltages. The first voltage is provided to the heater of each nozzle through the bus line 42; the second voltage is provided to the switch of each nozzle through the bus line 43.

Figure 6:
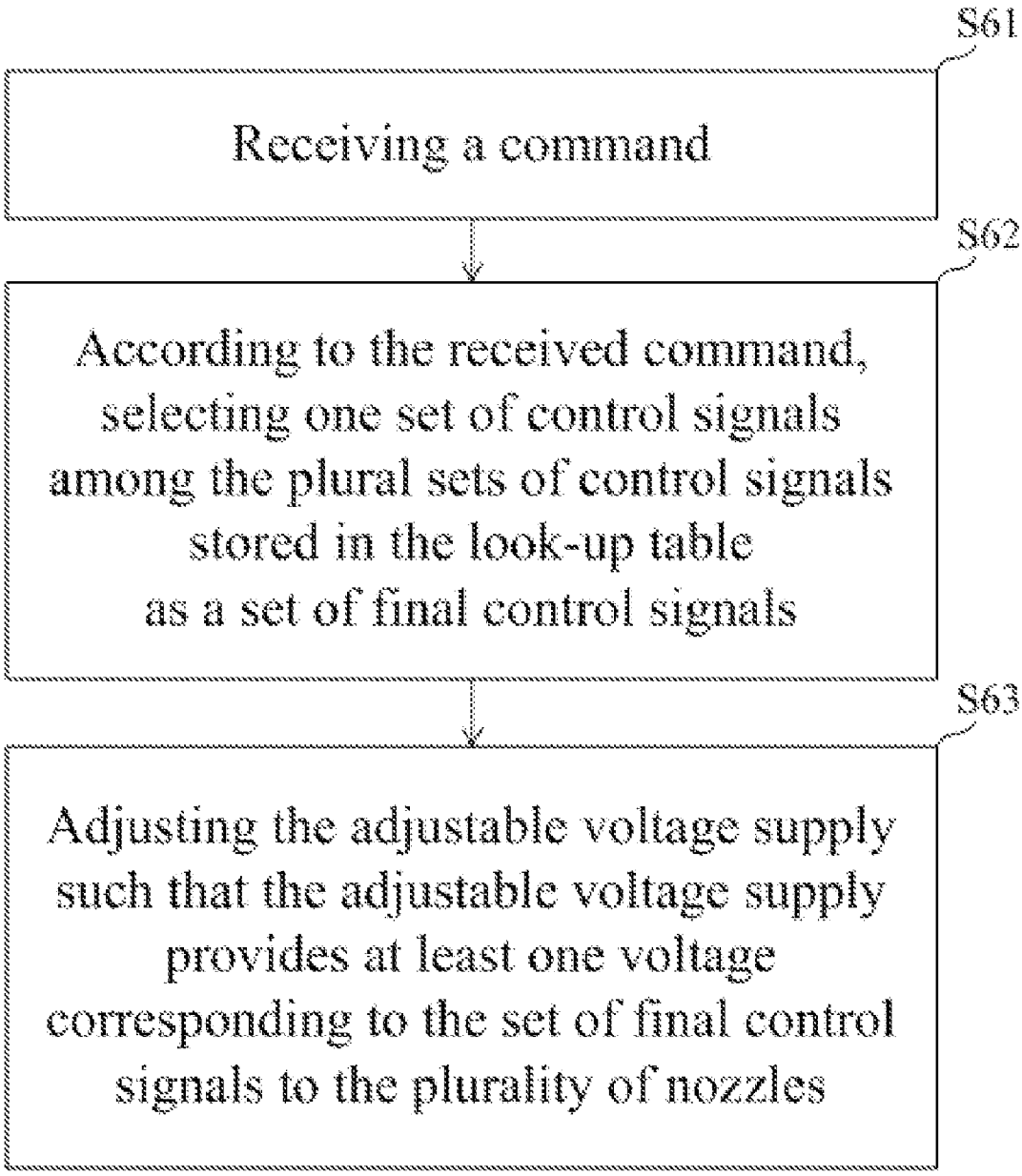
FIG. 6 shows the flowchart of the method of the third preferred embodiment according to this invention.

The third preferred embodiment according to this invention is a method of controlling an adjustable voltage supply for a print head comprised in a thermal inkjet printer. In this embodiment, a look-up table is previously provided for storing plural sets of control signals corresponding to a plurality of printing modes. Please refer to FIG. 6. FIG. 6 is the flowchart of this method. The first step S61 is receiving a command representing that a user selects one printing mode among the plurality of printing modes as a final printing mode. The second step S62 is selecting one set of control signals among the plural sets of control signals stored in the look-up table as a set of final control signals according to the command received in the first step. The set of final control signals is corresponding to the final printing mode. The third step S63 is adjusting the adjustable voltage supply such that the adjustable voltage supply provides at least one voltage corresponding to the set of final control signals to the plurality of nozzles.

Because the impedances of nozzles are brought into consideration, this invention can previously compensate the voltage variations caused by the impedances of nozzles and connecting wires according to the number of nozzles to be used in different printing modes. Thus, stable and accurate voltages are provided.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A power supplying apparatus for a print head comprised in a thermal inikjet printer, said print head comprising a plurality of nozzles, the thermal inikjet printer being capable of providing a plurality of printing modes, each printing mode being corresponding to a respective number of nozzles comprised in the print head, said power supplying apparatus comprising:

a look-up table for storing plural sets of control signals, each set of the control signals corresponding to one of the printing modes and information about the delay time of the nozzles receiving the control signals;

a selecting module for receiving a command, said command representing that a user selects one printing mode among the plurality of printing modes as a final printing mode, the selecting module selecting one set of control signals among the plural sets of control signals stored in the look-up table as a set of final control signals according to the command, the set of final control signals being corresponding to the final printing mode; and an adjustable voltage supply for supplying at least one voltage to the plurality of nozzles based on the set of final control signals selected by the selecting module.

2. The power supplying apparatus of claim 1, wherein the look-up table and the selecting module are integrated as a control unit.

3. The power supplying apparatus of claim 1, wherein each nozzle comprises a heater and a switch, the heater and the switch respectively has an impedance, and the plural sets of control signals are relative to the impedances of the heaters and the switches.

4. The power supplying apparatus of claim 3, wherein the adjustable voltage supply is connected to the plurality of nozzles via a bus line, said bus line has a serial impedance, and the plural sets of control signals stored in the look-up table are also relative to the serial impedance of the bus line.

5. The power supplying apparatus of claim 3, wherein the at least one voltage supplied by the adjustable voltage supply comprises a first voltage and a second voltage, the first voltage is provided to the heater of each nozzle, and the second voltage is provided to the switch of each nozzle.

6. A method of controlling an adjustable voltage supply for a print head comprised in a thermal inikjet printer, said print head comprising a plurality of nozzles, the thermal inikjet printer being capable of providing a plurality of printing modes, each printing mode being corresponding to a respective number of nozzles comprised in the print head, a look-up table being previously provided, the look-up table storing plural sets of control signals, each set of the control signals corresponding to one of the printing modes and information about the delay time of the nozzles receiving the control signals, said method comprising the steps of:

receiving a command representing that a user selects one printing mode among the plurality of printing modes as a final printing mode;

according to the received command, selecting one set of control signals among the plural sets of control signals stored in the look-up table as a set of final control signals, the set of final control signals being corresponding to the final printing mode; and adjusting the adjustable voltage supply such that the adjustable voltage supply provides at least one voltage corresponding to the set of final control signals to the plurality of nozzles.

7. The method of claim 6, wherein each nozzle comprises a heater and a switch, the heater and the switch respectively has an impedance, and the plural sets of control signals are relative to the impedances of the heaters and the switches.

8. The method of claim 7, wherein the adjustable voltage supply is connected to the plurality of nozzles via a bus line, said bus line has a serial impedance, and the plural sets of control signals stored in the look-up table are also relative to the serial impedance of the bus line.

9. The method of claim 7, wherein the at least one voltage supplied by the adjustable voltage supply comprises a first voltage and a second voltage, the first voltage is provided to the heater of each nozzle, and the second voltage is provided to the switch of each nozzle.

* * * * *